United States Patent [19]

Fischer

[11] 4,010,774

[45] Mar. 8, 1977

[54] ROTARY SPRAY STATION FOR BOTTLE WASHERS

[75] Inventor: Otto H. Fischer, Milwaukee, Wis.

[73] Assignee: Stowell Industries Inc., Milwaukee, Wis.

[22] Filed: Mar. 3, 1975

[21] Appl. No.: 554,905

[52] U.S. Cl. ..... 134/104; 134/73; 134/167 R; 134/171

[51] Int. Cl.[2] ..... B08B 3/02; B08B 9/08

[58] Field of Search ..... 134/72, 73, 104, 167 R, 134/171

[56] References Cited

UNITED STATES PATENTS

| | | | |
|---|---|---|---|
| 1,041,532 | 10/1912 | Wagner | 134/104 |

FOREIGN PATENTS OR APPLICATIONS

| | | | |
|---|---|---|---|
| 1,024,683 | 3/1966 | United Kingdom | 134/167 R |
| 439,449 | 12/1935 | United Kingdom | 134/104 |
| 217,221 | 6/1968 | U.S.S.R. | 134/73 |

*Primary Examiner*—Robert L. Bleutge
*Attorney, Agent, or Firm*—Michael, Best & Friedrich

[57] ABSTRACT

As the bottles go through the bottle washing machines the inside of each bottle is sprayed at various locations at each of which the bottle conveyor travels an arcuate path, the center of which is generally coincident with the center of the rotary spray pipe. The rotary spray pipe is provided with rows of aligned spray nozzles each of which lines up with the neck of a bottle in the conveyor as it passes over the spray area. A header surrounds the pipe at each nozzle location with a segment of the header removed to allow the nozzles to spray the adjacent bottles as the nozzles pass the cutout section. For the remainder of a revolution the nozzle is blanked off by the header. The bottles are always synchronized with the nozzles since the conveyor sprocket rotates with the spray pipe. A backflush pipe is fixed below and communicates with the header so water can be flushed through the nozzles in reverse direction for cleaning.

2 Claims, 3 Drawing Figures

ROTARY SPRAY STATION FOR BOTTLE WASHERS

BACKGROUND OF THE INVENTION

In bottle washing machines it is necessary to spray the inside of the bottle at various stages. The conveyor must be kept running. In order to obtain any meaningful flow into the bottle the bottle must be aligned with the spray for some period of time. In the past the spray nozzle was made to travel with the conveyor for some distance and then return to its starting point. This reciprocating motion becomes a limiting factor on conveyor speed and with conveyor speed limited the machine output was limited.

SUMMARY OF THE INVENTION

The present construction utilizes rotary motion for the spray head, thus allowing the conveyor to be operated at substantially greater speeds than used in conjunction with the prior reciprocating spray heads. With the present design the spray from the rotating nozzle is aligned with the bottle up to 120° of travel and achieves effective action. Since all action is rotary and continuous, the conveyor speed can be increased substantially with productivity well in excess of that obtained in any prior design.

DESCRIPTION OF THE PREFERRED EMBODIMENT

Figure 1:
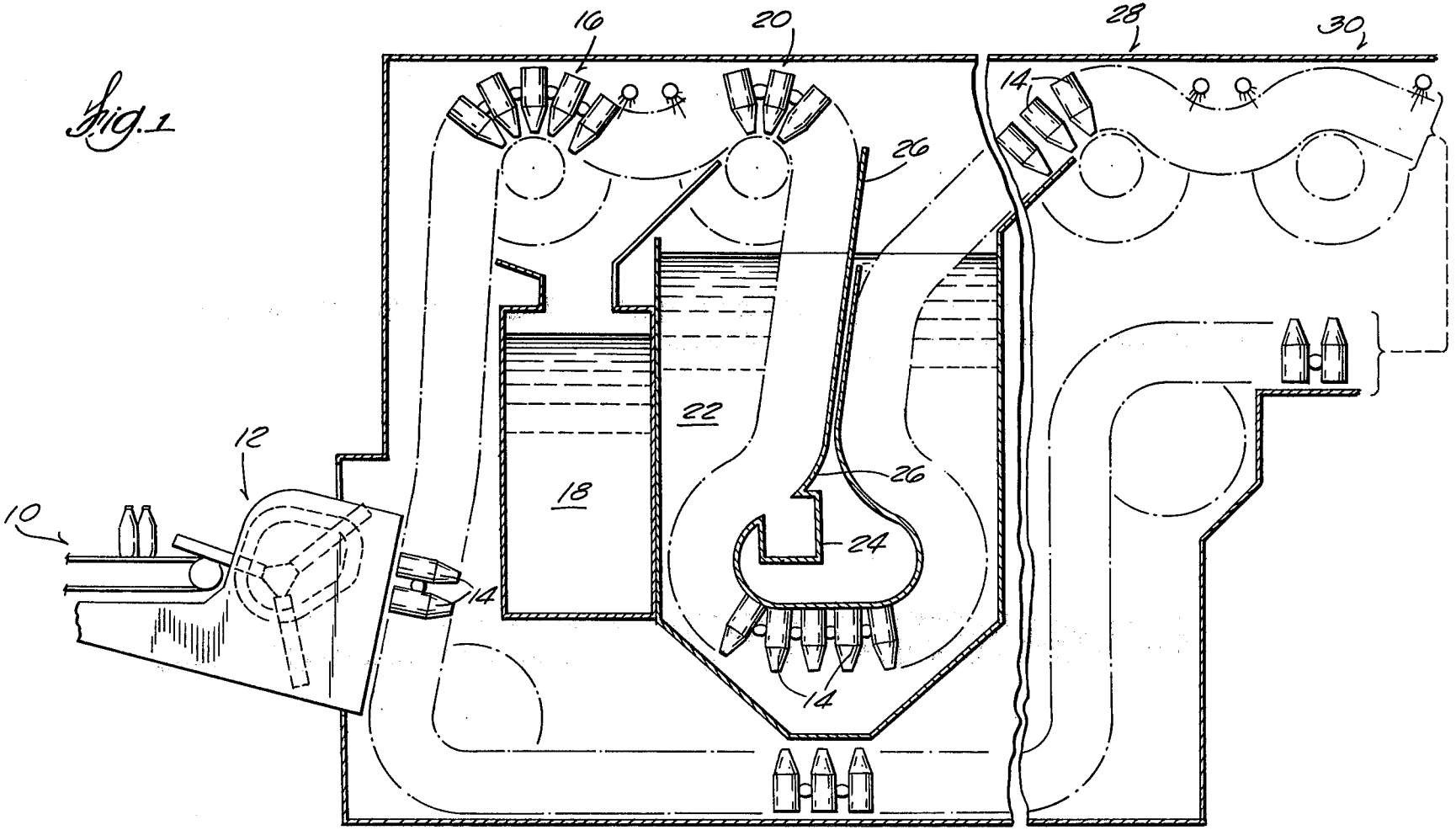
FIG. 1 is a somewhat schematicized representation of a bottle washing machine incorporating the present invention and serves to give the environment of the present invention.
Figure 3:
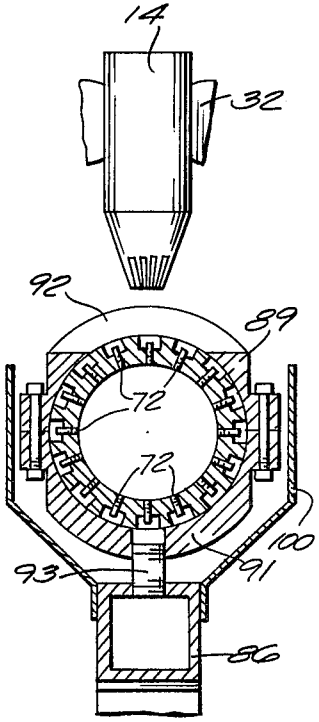
FIG. 3 is a vertical section taken on line 3—3 in FIG. 2.
Figure 2:
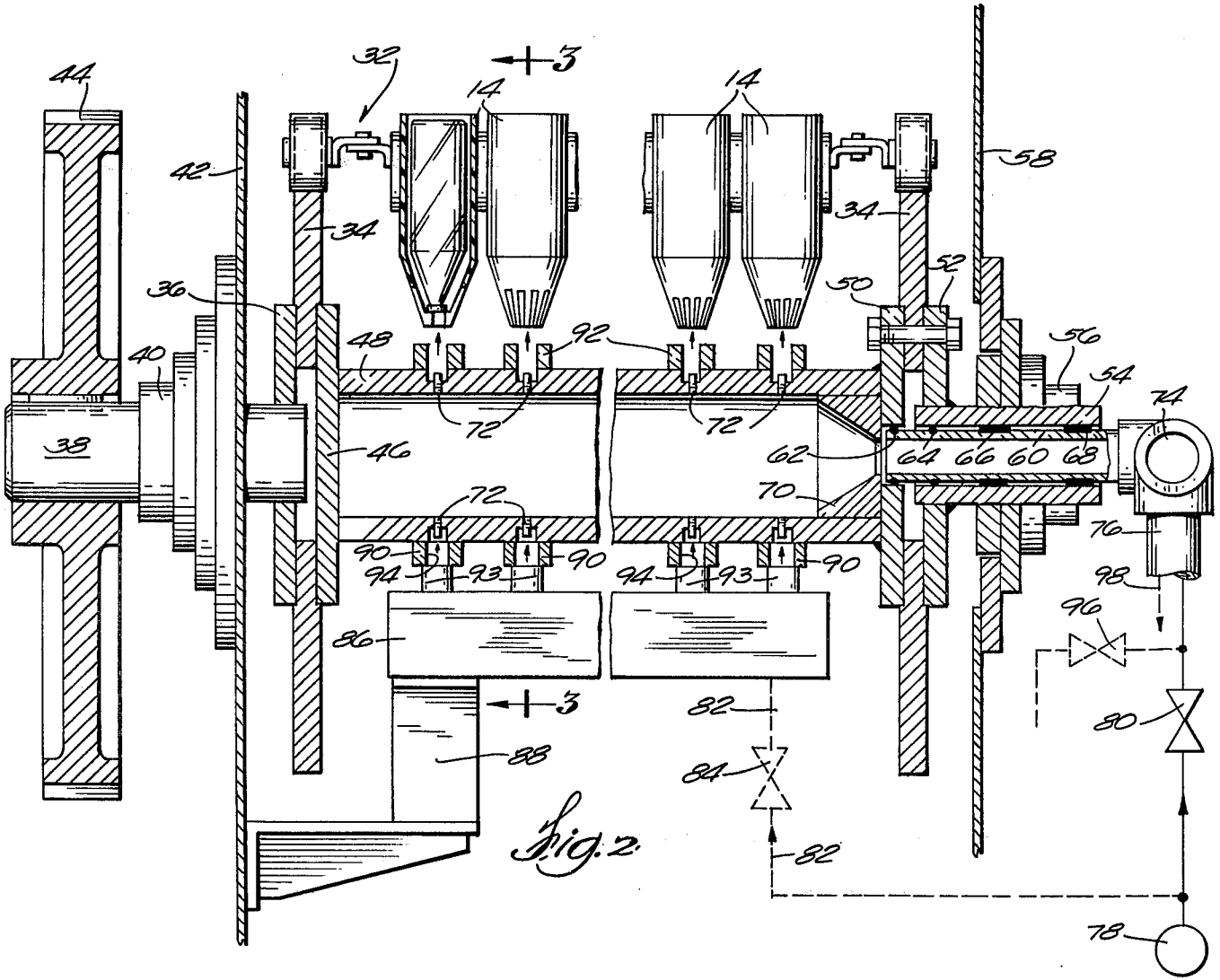
FIG. 2 is a vertical section through a rotary header in the machine.

Bottles are fed into the bottle washing machine at the left in FIG. 1 on the infeed conveyor 10 and are picked up by the transfer mechanism 12 to be placed in pockets 14 on the endless conveyor. These pockets are open bottomed plastic containers and each is provided with a web-like neck which permits free flow of water through the cylindrical portion of the pocket from either end of the pocket. When the pockets are inverted they support the bottles in the web-like neck. When the pockets are upright a guide surface is provided to keep the bottles from falling out of the pockets. This sort of arrangement is quite standard.

The conveyor follows the serpentine path through the machine and transports the bottles to the various stations where the bottles may be subjected to a presoak or rinse at 16, the pre-rinse reservoir 18 underlying the station. The bottles receive a hot caustic spray at 20 with a soak then occurring in the tank section 22 where there may be a glass scavenge or recovery receptacle 24. It will be noted that as the bottles move to the left in tank 22 they follow a guide 26 to prevent the bottles slipping out of the pockets. This guide also serves to deflect and direct broken bottles into the glass scavenge container 24. Following this the bottles are transported through a number of caustic rinses and the like followed by a spray station 28 and a number of rinse stations such as 30. Following that procedure the clean bottles are discharged from the machine at a station, not shown. The return path of the conveyor is at the bottom of FIG. 1.

This invention is concerned with the method of subjecting the bottles to an internal spray at such stations as 16, 20, 28, and 30. Snce it is desired to operate the conveyor at high speed, the prior art method of mounting the spray heads on a reciprocating mechanism cannot be utilized since this would incur such high forces at each end of the reciprocating motion. The machinery could not stand up in service.

The conveyor itself is made up of a chain at each side of the machine and the chains are interconnected by bars 32 which serve to support the pockets 14 across the width of the machine. At each end of each bar 32 there is a pair of rollers which are adapted to roll in guides and to also engage and be driven by the chain sprocket wheels 34. The bars and, hence, the pockets are always in a fixed relation to the guide wheels running over the guides or the sproket wheels. The bottles are transported through the machine in a precise location relative to the teeth on the sproket. In a representative spray station the left-hand sprocket 34 is bolted to flange 36 on the shaft 38 journaled in roller bearings 40 supported in the outer wall 42 of the bottle washing machine. Shaft 38 may be a stub shaft (in which case the sprocket 34 is an idler) or may be a driven shaft by provision of the drive pulley 44 splined to the end of the shaft. On the inside of the left sprocket 34 there is a flat plate 46 which is welded to the spray pipe 48. The end of the spray pipe is welded to an annulus 50 bolted to the right sprocket 34 and an annulus 52 which is welded to sleeve 54 journaled in bearing 56 in the panel or side wall 58 of the bottle washing machine. A pipe 60 supplies the spray liquid and is mounted inside sleeve 54 and sealed with respect to the sleeve 54 and with respect to annulus 50 by O-rings 62, 64. Pipe 60 is provided with replaceable wear surfaces in the form of teflon tape 66, 68. On the right end of the spray pipe 48 there is a divergent section 70 which serves principally to direct the flow to the pipe 60 during reverse flow or backflush operation. The pipe 48 is provided with axially spaced circumferential rows of spray nozzles 72. These nozzles are individually replaceable and are accurately located relative to the sprocket wheel 34 and, hence, relative to the pockets on the conveyor and, therefore, relative to the bottles in the pockets. Thus a nozzle will be in alignment with each bottle as the bottle passes the spray station.

Liquid is supplied to the interior of the pipe through the fitting 74 and pipe 76 leading from pump 78 and regulated by valve 80 which is normally open. Flow through branch conduit 82 is regulated by normally closed valve 84 which, when open, allows flow to backwash manifold 86 supported on bracket 88 fixed to the inside of the bottle washing machine wall 42. Flow from the nozzles is regulated at each circumferential row of nozzles by a header 90 which, in effect, wraps around the spray pipe and is comprised of two parts 88, 91 bolted together. The upper part of the header 90 is cut out at 92 for up to 120°. As the rotating nozzle comes to the cutout section 92 the liquid is free to pass through the nozzle and spray the bottle positioned directly opposite the nozzle for the 120° of rotation. Thereafter the spray from the nozzle is blanked off by the solid header. The 120° of alignment of the nozzle with the bottle is adequate to achieve a good spray action on the interior of the bottle even though the conveyor is traveling at much higher speeds than heretofore attained in bottle washing machines.

It will be noted that the backwash manifold 86 is connected to each header by a nipple 93 communicating with a port 94 at the bottom of each header. Normally there is no effect since there is no outlet from the manifold but if the valve 84 is opened and the valve 80 is closed and valve 96 in the waste conduit 98 is opened, the flow from pump 78 is reversed through the spray nozzles. Thus it passes through valve 84 and conduit 82 to the manifold 86, the various nipples 93, and ports 94. Therefore, as each nozzle passes a port 94 it will be subjected to a reverse flow. This flushes foreign objects from the nozzle into the interior of pipe 48 and to the converging section 70 leading to pipe 60 and ultimately to the waste pipe 98. In this way the nozzles can be kept clean and operational. If, however, any nozzle should become plugged, it can be replaced individually without tearing down the machine since it can be reached through the cutout 92 in the header.

The header is not completely effective to prevent leakage past the header since there must be some clearance between the header and the rotating spray pipe. For this reason spray shields 100 are provided simply to confine the spray. The fact there is spray at this point leaking past the header is of no consequence insofar as the effectiveness of the machine is concerned.

I claim:

1. A bottle washing machine of the type having a conveyor transporting bottles through the machine in parallel rows, the bottles in each row being spaced and supported to remain normal to the conveyor on straight runs of the conveyor and to be radially disposed where the conveyor follows a curved path, the improvement comprising a spray station located where the conveyor follows a curved path with the necks of the bottles facing the center of curvature, the bottles in each row being angularly spaced at the spray station, a pipe at the spray station rotated in synchronism with the conveyor drive, axially spaced rows of circumferentially disposed nozzles mounted on the pipe in alignment with the rows of bottles on the conveyor, the angular spacing of the nozzles in each row corresponding to the angular spacing of the bottles passing over the curved spray station with each nozzle being aligned with a bottle as the bottle passes the spray station so the spray from the nozzle is aligned with the bottle for the angular embrace of the bottle travel over the curved path, pump means delivering liquid under pressure to the interior of the pipe, a stationary header embracing a circumferential portion of said pipe and substantially blocking spray from the nozzles as they travel outside said angular embrace, said header including a normally inoperative flow path which, when operative, permits liquid under pressure to be injected through each nozzle in the reverse direction as the nozzle is aligned with the flow path, and means for rendering the flow path operative and permitting the liquid to be withdrawn from the interior of said pipe.

2. A bottle washing maching according to claim 1 in which the header embracing the rotary pipe has a cutout section corresponding to said angular embrace and the flow path includes a port in the header in alignment with each row of nozzles, the header including a manifold communicating with each port so that when said flow path is operative liquid is directed into the manifold to the ports and then to the nozzles to flush the nozzles.

* * * * *